US010480196B2

(12) United States Patent
Boo

(10) Patent No.: US 10,480,196 B2
(45) Date of Patent: Nov. 19, 2019

(54) BUILDING PANEL WITH A MECHANICAL LOCKING SYSTEM

(71) Applicant: VÄLINGE INNOVATION AB, Viken (SE)

(72) Inventor: Christian Boo, Kagerod (SE)

(73) Assignee: VALINGE INNOVATION AB, Viken (SE)

( * ) Notice: Subject to any disclaimer, the term of this patent is extended or adjusted under 35 U.S.C. 154(b) by 0 days.

(21) Appl. No.: 16/163,693

(22) Filed: Oct. 18, 2018

(65) Prior Publication Data

US 2019/0048592 A1 Feb. 14, 2019

Related U.S. Application Data

(63) Continuation of application No. 15/583,002, filed on May 1, 2017, now Pat. No. 10,125,488, which is a (Continued)

(51) Int. Cl.
*E04F 13/076* (2006.01)
*E04F 15/02* (2006.01)
(Continued)

(52) U.S. Cl.
CPC ..... *E04F 13/076* (2013.01); *E04B 1/54* (2013.01); *E04C 2/38* (2013.01); *E04F 13/0889* (2013.01);
(Continued)

(58) Field of Classification Search
CPC ..... E04F 15/02038; E04F 15/02005; E04F 15/02; E04F 2201/0115; E04F 2201/0107;
(Continued)

(56) References Cited

U.S. PATENT DOCUMENTS 8,068 A 4/1851 Boynton
87,853 A 3/1869 Kappes
(Continued)

FOREIGN PATENT DOCUMENTS

DE 299 22 649 U1 3/2000
DE 10 2009 048 050 B3 1/2011
(Continued)

OTHER PUBLICATIONS

International Search Report issued in PCT/SE2013/050367, dated Jun. 24, 2013, Patent-och registreringsverket, Stockholm, SE, 6 pages.

(Continued)

*Primary Examiner* — Christine T Cajilig
(74) *Attorney, Agent, or Firm* — Buchanan Ingersoll & Rooney P.C.

(57) ABSTRACT

Building panels provided with a mechanical locking system including a tongue, at an edge of a first panel, cooperating with a tongue groove, at an edge of an adjacent second panel, for vertical locking of the building panels. The edge of the first panel is provided with a displacement groove, which is downwardly open, and includes an inner wall, an outer wall, and an upper wall. The tongue is formed out of the edge of the first panel. A resilient and displaceable and part of the tongue is displaceable into the displacement groove.

25 Claims, 12 Drawing Sheets

Related U.S. Application Data continuation of application No. 15/066,722, filed on Mar. 10, 2016, now Pat. No. 9,663,940, which is a continuation of application No. 14/794,308, filed on Jul. 8, 2015, now Pat. No. 9,316,002, which is a continuation of application No. 14/612,881, filed on Feb. 3, 2015, now Pat. No. 9,091,077, which is a continuation of application No. 14/074,273, filed on Nov. 7, 2013, now Pat. No. 8,973,331, which is a continuation of application No. 13/855,966, filed on Apr. 3, 2013, now Pat. No. 8,596,013.

(60) Provisional application No. 61/620,233, filed on Apr. 4, 2012.

(51) Int. Cl.

| | |
|---|---|
| ***E04F 15/10*** | (2006.01) |
| ***E04F 13/08*** | (2006.01) |
| ***E04C 2/38*** | (2006.01) |
| ***E04B 1/61*** | (2006.01) |

(52) U.S. Cl.

CPC .... *E04F 13/0894* (2013.01); *E04F 15/02038* (2013.01); *E04F 15/10* (2013.01); *E04F 2201/0138* (2013.01); *E04F 2201/0146* (2013.01); *E04F 2201/023* (2013.01); *E04F 2201/041* (2013.01); *E04F 2201/042* (2013.01); *E04F 2201/043* (2013.01); *E04F 2201/044* (2013.01)

(58) Field of Classification Search

CPC ..... E04F 2201/0146; E04F 2201/0138; E04F 2201/0161; E04F 2201/01; E04F 2201/53; E04F 2201/041

See application file for complete search history.

(56) References Cited

U.S. PATENT DOCUMENTS

| | | | | |
|---|---|---|---|---|
| 124,228 | A | 3/1872 | Stuart | |
| 213,740 | A | 4/1879 | Conner | |
| 274,354 | A | 3/1883 | McCarthy et al. | |
| 316,176 | A | 4/1885 | Ransom | |
| 634,581 | A | 10/1899 | Miller | |
| 861,911 | A | 7/1907 | Stewart | |
| 1,194,636 | A | 8/1916 | Joy | |
| 1,723,306 | A | 8/1929 | Sipe | |
| 1,743,492 | A | 1/1930 | Sipe | |
| 1,809,393 | A | 6/1931 | Rockwell | |
| 1,902,716 | A | 3/1933 | Newton | |
| 2,026,511 | A | 12/1935 | Storm | |
| 2,204,675 | A | 6/1940 | Grunert | |
| 2,277,758 | A | 3/1942 | Hawkins | |
| 2,430,200 | A | 11/1947 | Wilson | |
| 2,497,837 | A | 2/1950 | Nelson | |
| 2,596,280 | A | 5/1952 | Nystrom | |
| 2,732,706 | A | 1/1956 | Friedman | |
| 2,740,167 | A | 4/1956 | Rowley | |
| 2,863,185 | A | 12/1958 | Riedi | |
| 2,865,058 | A | 12/1958 | Andersson | |
| 2,872,712 | A | 2/1959 | Brown | |
| 2,889,016 | A | 6/1959 | Warren | |
| 3,023,681 | A | 3/1962 | Worson | |
| 3,077,703 | A | 2/1963 | Bergstrom | |
| 3,099,110 | A | 7/1963 | Spaight | |
| 3,147,522 | A | 9/1964 | Schumm | |
| 3,271,787 | A | 9/1966 | Clary | |
| 3,325,585 | A | 6/1967 | Brenneman | |
| 3,378,958 | A | 4/1968 | Parks et al. | |
| 3,396,640 | A | 8/1968 | Fujihara | |
| 3,512,324 | A | 5/1970 | Reed | |
| 3,517,927 | A | 6/1970 | Kennel | |
| 3,526,071 | A | 9/1970 | Watanabe | |
| 3,535,844 | A | 10/1970 | Glaros | |
| 3,572,224 | A | 3/1971 | Perry | |
| 3,579,941 | A | 5/1971 | Tibbals | |
| 3,720,027 | A | 3/1973 | Christensen | |
| 3,722,379 | A | 3/1973 | Koester | |
| 3,742,669 | A | 7/1973 | Mansfeld | |
| 3,760,547 | A | 9/1973 | Brenneman | |
| 3,760,548 | A | 9/1973 | Sauer et al. | |
| 3,778,954 | A | 12/1973 | Meserole | |
| 3,849,235 | A | 11/1974 | Gwynne | |
| 3,889,736 | A | 6/1975 | Firks | |
| 3,919,820 | A | 11/1975 | Green | |
| 3,950,915 | A | 4/1976 | Cole | |
| 3,998,015 | A | 12/1976 | Scott et al. | |
| 4,030,852 | A | 6/1977 | Hein | |
| 4,064,571 | A | 12/1977 | Phipps | |
| 4,080,086 | A | 3/1978 | Watson | |
| 4,082,129 | A | 4/1978 | Morelock | |
| 4,100,710 | A | 7/1978 | Kowallik | |
| 4,107,892 | A | 8/1978 | Bellem | |
| 4,113,399 | A | 9/1978 | Hansen, Sr. et al. | |
| 4,169,688 | A | 10/1979 | Toshio | |
| 4,196,554 | A | 4/1980 | Anderson | |
| 4,227,430 | A | 10/1980 | Janssen et al. | |
| 4,299,070 | A | 11/1981 | Oltmanns | |
| 4,304,083 | A | 12/1981 | Anderson | |
| 4,426,820 | A | 1/1984 | Terbrack | |
| 4,447,172 | A | 5/1984 | Galbreath | |
| 4,512,131 | A | 4/1985 | Laramore | |
| 4,599,841 | A | 7/1986 | Haid | |
| 4,648,165 | A | 3/1987 | Whitehorne | |
| 5,007,222 | A | 4/1991 | Raymond | |
| 5,071,282 | A | 12/1991 | Brown | |
| 5,148,850 | A | 9/1992 | Urbanick | |
| 5,173,012 | A | 12/1992 | Ortwein et al. | |
| 5,182,892 | A | 2/1993 | Chase | |
| 5,247,773 | A | 9/1993 | Weir | |
| 5,272,850 | A | 12/1993 | Mysliwiec et al. | |
| 5,344,700 | A | 9/1994 | McGath et al. | |
| 5,348,778 | A | 9/1994 | Knipp et al. | |
| 5,465,546 | A | 11/1995 | Buse | |
| 5,485,702 | A | 1/1996 | Sholton | |
| 5,548,937 | A | 8/1996 | Shimonohara | |
| 5,598,682 | A | 2/1997 | Haughian | |
| 5,618,602 | A | 4/1997 | Nelson | |
| 5,634,309 | A | 6/1997 | Polen | |
| 5,658,086 | A | 8/1997 | Brokaw et al. | |
| 5,671,575 | A | 9/1997 | Wu | |
| 5,694,730 | A | 12/1997 | Del Rincon et al. | |
| 5,755,068 | A | 5/1998 | Ormiston | |
| 5,899,038 | A | 5/1999 | Stroppiana | |
| 5,950,389 | A | 9/1999 | Porter | |
| 5,970,675 | A | 10/1999 | Schray | |
| 6,006,486 | A | 12/1999 | Moriau | |
| 6,029,416 | A | 2/2000 | Andersson | |
| 6,052,960 | A | 4/2000 | Yonemura | |
| 6,065,262 | A | 5/2000 | Motta | |
| 6,173,548 | B1 | 1/2001 | Hamar et al. | |
| 6,182,410 | B1 | 2/2001 | Pervan | |
| 6,216,409 | B1 | 4/2001 | Roy et al. | |
| 6,314,701 | B1 | 11/2001 | Meyerson | |
| 6,363,677 | B1 | 4/2002 | Chen et al. | |
| 6,385,936 | B1 | 5/2002 | Schneider | |
| 6,418,683 | B1 | 7/2002 | Martensson et al. | |
| 6,446,413 | B1 | 9/2002 | Gruber | |
| 6,449,918 | B1 | 9/2002 | Nelson | |
| 6,505,452 | B1 | 1/2003 | Hannig | |
| 6,553,724 | B1 | 4/2003 | Bigler | |
| 6,591,568 | B1 * | 7/2003 | P'522 lsson ..... | E04F 15/02 52/592.2 |
| 6,601,359 | B2 | 8/2003 | Olofsson | |
| 6,617,009 | B1 | 9/2003 | Chen et al. | |
| 6,647,689 | B2 | 11/2003 | Pletzer et al. | |
| 6,647,690 | B1 | 11/2003 | Martensson | |
| 6,651,400 | B1 | 11/2003 | Murphy | |
| 6,670,019 | B2 | 12/2003 | Andersson | |
| 6,685,391 | B1 | 2/2004 | Gideon | |
| 6,763,643 | B1 | 7/2004 | Martensson | |
| 6,766,622 | B1 | 7/2004 | Thiers | |

(56) References Cited

U.S. PATENT DOCUMENTS 6,769,219 B2 8/2004 Schwitte et al.
6,769,835 B2 8/2004 Stridsman
6,804,926 B1 10/2004 Eisermann
6,862,857 B2 3/2005 Tychsen
6,865,855 B2 3/2005 Knauseder
6,874,291 B1 4/2005 Weber
6,948,716 B2 9/2005 Drouin
7,021,019 B2 4/2006 Knauseder
7,051,486 B2 5/2006 Pervan
7,108,031 B1 9/2006 Secrest
7,137,229 B2 11/2006 Pervan
7,152,383 B1 12/2006 Wilkinson et al.
7,188,456 B2 3/2007 Knauseder
7,219,392 B2 5/2007 Mullet et al.
7,219,409 B2 * 5/2007 Jecker ..... A47B 77/022 29/402.01
7,251,916 B2 8/2007 Konzelmann et al.
7,257,926 B1 8/2007 Kirby
7,337,588 B1 3/2008 Moebus
7,377,081 B2 5/2008 Ruhdorfer
7,451,578 B2 11/2008 Hannig
7,454,875 B2 11/2008 Pervan et al.
7,516,588 B2 * 4/2009 Pervan ..... B27F 5/026 52/591.1
7,533,500 B2 5/2009 Morton et al.
7,556,849 B2 7/2009 Thompson et al.
7,568,322 B2 8/2009 Pervan
7,584,583 B2 * 9/2009 Bergelin ..... E04F 15/02 52/588.1
7,614,197 B2 11/2009 Nelson
7,617,651 B2 11/2009 Grafenauer
7,621,092 B2 11/2009 Groeke et al.
7,634,884 B2 12/2009 Pervan
7,637,068 B2 12/2009 Pervan
7,654,055 B2 2/2010 Ricker
7,677,005 B2 3/2010 Pervan
7,685,691 B2 3/2010 Jecker
7,716,889 B2 5/2010 Pervan
7,721,503 B2 5/2010 Pervan et al.
7,726,088 B2 6/2010 Muehlebach
7,757,452 B2 7/2010 Pervan
7,802,411 B2 9/2010 Pervan
7,806,624 B2 10/2010 McLean et al.
7,841,144 B2 11/2010 Pervan et al.
7,841,145 B2 11/2010 Pervan et al.
7,841,150 B2 11/2010 Pervan
7,856,789 B2 12/2010 Eisermann
7,861,482 B2 1/2011 Pervan et al.
7,866,110 B2 1/2011 Pervan
7,908,815 B2 3/2011 Pervan et al.
7,930,862 B2 4/2011 Bergelin et al.
7,980,039 B2 7/2011 Groeke
7,980,041 B2 7/2011 Pervan
8,033,074 B2 10/2011 Pervan
8,042,311 B2 10/2011 Pervan
8,061,104 B2 11/2011 Pervan
8,079,196 B2 12/2011 Pervan
8,099,924 B2 * 1/2012 Braun ..... E04F 15/02 52/588.1
8,112,967 B2 2/2012 Pervan et al.
8,171,692 B2 5/2012 Pervan
8,181,416 B2 5/2012 Pervan et al.
8,234,830 B2 8/2012 Pervan et al.
8,302,361 B2 11/2012 Braun et al.
8,302,367 B2 11/2012 Schulte
8,336,272 B2 12/2012 Prager et al.
8,341,914 B2 1/2013 Pervan et al.
8,341,915 B2 1/2013 Pervan et al.
8,353,140 B2 1/2013 Pervan et al.
8,359,805 B2 1/2013 Pervan et al.
8,381,477 B2 2/2013 Pervan et al.
8,387,327 B2 3/2013 Pervan
8,448,402 B2 5/2013 Pervan et al.
8,499,521 B2 8/2013 Pervan et al.
8,505,257 B2 8/2013 Boo et al.
8,511,040 B2 8/2013 Braun et al.
8,528,289 B2 9/2013 Pervan et al.
8,544,230 B2 10/2013 Pervan
8,544,234 B2 10/2013 Pervan et al.
8,572,922 B2 11/2013 Pervan
8,596,013 B2 12/2013 Boo
8,627,862 B2 1/2014 Pervan et al.
8,640,424 B2 2/2014 Pervan et al.
8,650,826 B2 2/2014 Pervan et al.
8,677,714 B2 3/2014 Pervan
8,689,512 B2 4/2014 Pervan
8,707,650 B2 4/2014 Pervan
8,713,886 B2 5/2014 Boo et al.
8,733,065 B2 5/2014 Pervan
8,733,410 B2 5/2014 Pervan
8,763,341 B2 7/2014 Pervan
8,769,905 B2 7/2014 Pervan
8,776,473 B2 7/2014 Pervan et al.
8,844,236 B2 9/2014 Pervan et al.
8,857,126 B2 10/2014 Pervan et al.
8,869,485 B2 10/2014 Pervan
8,898,988 B2 12/2014 Pervan
8,925,274 B2 1/2015 Pervan et al.
8,959,866 B2 2/2015 Pervan
8,973,331 B2 3/2015 Boo
9,027,306 B2 5/2015 Pervan
9,051,738 B2 6/2015 Pervan et al.
9,068,360 B2 6/2015 Pervan
9,091,077 B2 7/2015 Boo
9,194,134 B2 11/2015 Nygren et al.
9,212,492 B2 12/2015 Pervan et al.
9,216,541 B2 12/2015 Boo et al.
9,238,917 B2 1/2016 Pervan et al.
9,284,737 B2 3/2016 Pervan et al.
9,309,679 B2 4/2016 Pervan et al.
9,316,002 B2 4/2016 Boo
9,340,974 B2 5/2016 Pervan et al.
9,347,469 B2 5/2016 Pervan
9,359,774 B2 6/2016 Pervan
9,366,036 B2 6/2016 Pervan
9,376,821 B2 6/2016 Pervan
9,382,716 B2 7/2016 Pervan et al.
9,388,584 B2 7/2016 Pervan et al.
9,428,919 B2 8/2016 Pervan et al.
9,453,347 B2 9/2016 Pervan
9,458,634 B2 10/2016 Derelov
9,482,012 B2 11/2016 Nygren et al.
9,540,826 B2 1/2017 Pervan et al.
9,663,940 B2 5/2017 Boo
9,725,912 B2 8/2017 Pervan
9,771,723 B2 9/2017 Pervan
9,777,487 B2 10/2017 Pervan et al.
9,803,374 B2 10/2017 Pervan
9,803,375 B2 10/2017 Pervan
9,856,656 B2 1/2018 Pervan
9,874,027 B2 1/2018 Pervan
9,945,130 B2 4/2018 Nygren et al.
9,951,526 B2 4/2018 Boo et al.
10,006,210 B2 6/2018 Pervan et al.
10,017,948 B2 7/2018 Boo
10,113,319 B2 10/2018 Pervan
10,125,488 B2 11/2018 Boo
10,138,636 B2 11/2018 Pervan
10,161,139 B2 12/2018 Pervan
10,180,005 B2 1/2019 Pervan et al.
10,214,915 B2 2/2019 Pervan et al.
10,214,917 B2 2/2019 Pervan et al.
2002/0170258 A1 11/2002 Schwitte et al.
2003/0180091 A1 9/2003 Stridsman
2004/0016196 A1 1/2004 Pervan
2004/0031227 A1 2/2004 Knauseder
2004/0128934 A1 7/2004 Hecht
2004/0168392 A1 9/2004 Konzelmann et al.
2004/0211143 A1 10/2004 Hannig
2004/0244325 A1 12/2004 Nelson
2005/0028474 A1 2/2005 Kim
2005/0050827 A1 3/2005 Schitter
2005/0160694 A1 7/2005 Pervan
2005/0210810 A1 9/2005 Pervan

(56) References Cited

U.S. PATENT DOCUMENTS

2006/0070333 A1 4/2006 Pervan
2006/0101769 A1 5/2006 Pervan
2006/0156670 A1 7/2006 Knauseder
2006/0236642 A1 10/2006 Pervan
2006/0260254 A1 11/2006 Pervan et al.
2007/0006543 A1 1/2007 Engström
2007/0011981 A1 1/2007 Eiserman
2007/0193178 A1 8/2007 Groeke et al.
2008/0000186 A1 1/2008 Pervan et al.
2008/0000187 A1 1/2008 Pervan et al.
2008/0010931 A1 1/2008 Pervan et al.
2008/0010937 A1 1/2008 Pervan et al.
2008/0028707 A1 2/2008 Pervan
2008/0034708 A1 2/2008 Pervan
2008/0041008 A1 2/2008 Pervan
2008/0066415 A1 3/2008 Pervan
2008/0104921 A1 5/2008 Pervan et al.
2008/0110125 A1 5/2008 Pervan
2008/0134607 A1 6/2008 Pervan
2008/0134613 A1 6/2008 Pervan
2008/0134614 A1 6/2008 Pervan
2008/0155930 A1 7/2008 Pervan et al.
2008/0216434 A1 9/2008 Pervan
2008/0216920 A1 9/2008 Pervan
2008/0295432 A1 12/2008 Pervan et al.
2009/0019806 A1 1/2009 Muehlebach
2009/0100782 A1 4/2009 Groeke et al.
2009/0133353 A1 5/2009 Pervan et al.
2009/0173032 A1 7/2009 Prager et al.
2009/0193741 A1 8/2009 Capelle
2009/0193748 A1 8/2009 Boo et al.
2010/0037550 A1 2/2010 Braun
2010/0051779 A1* 3/2010 McCary ..... E04B 2/8635 249/33
2010/0173122 A1 7/2010 Susnjara
2010/0218450 A1 9/2010 Braun et al.
2010/0293879 A1 11/2010 Pervan et al.
2010/0300029 A1* 12/2010 Braun ..... E04F 15/02 52/588.1
2010/0300031 A1 12/2010 Pervan et al.
2010/0319290 A1 12/2010 Pervan
2010/0319291 A1 12/2010 Pervan et al.
2011/0030303 A1 2/2011 Pervan et al.
2011/0041996 A1 2/2011 Pervan
2011/0088344 A1 4/2011 Pervan et al.
2011/0088345 A1 4/2011 Pervan
2011/0088346 A1 4/2011 Hannig
2011/0154763 A1 6/2011 Bergelin et al.
2011/0167750 A1 7/2011 Pervan
2011/0225922 A1 9/2011 Pervan et al.
2011/0252733 A1 10/2011 Pervan
2011/0258959 A1* 10/2011 Braun ..... E04F 15/02 52/588.1
2011/0283650 A1 11/2011 Pervan et al.
2012/0017533 A1 1/2012 Pervan et al.
2012/0031029 A1 2/2012 Pervan et al.
2012/0036804 A1 2/2012 Pervan
2012/0067461 A1 3/2012 Braun
2012/0096801 A1* 4/2012 Cappelle ..... E04F 15/02038 52/592.1
2012/0151865 A1 6/2012 Pervan et al.
2012/0174515 A1 7/2012 Pervan
2012/0174520 A1 7/2012 Pervan
2012/0174521 A1* 7/2012 Schulte ..... E04F 13/08 52/588.1
2012/0192521 A1* 8/2012 Schulte ..... E04F 13/08 52/588.1
2012/0279161 A1 11/2012 Håkansson et al.
2013/0008117 A1 1/2013 Pervan
2013/0014463 A1 1/2013 Pervan
2013/0019555 A1 1/2013 Pervan
2013/0036695 A1* 2/2013 Durnberger ..... E04F 15/02038 52/309.3
2013/0042562 A1 2/2013 Pervan
2013/0042563 A1 2/2013 Pervan
2013/0042564 A1 2/2013 Pervan et al.
2013/0042565 A1 2/2013 Pervan
2013/0047536 A1 2/2013 Pervan
2013/0055950 A1 3/2013 Pervan et al.
2013/0081349 A1 4/2013 Pervan et al.
2013/0111845 A1 5/2013 Pervan
2013/0145708 A1 6/2013 Pervan
2013/0160390 A1* 6/2013 Stockl ..... E04F 15/02 52/588.1
2013/0160391 A1 6/2013 Pervan et al.
2013/0192158 A1* 8/2013 Cappelle ..... B32B 7/02 52/588.1
2013/0205710 A1* 8/2013 Brailsford ..... E04F 13/0871 52/742.14
2013/0232905 A2 9/2013 Pervan
2013/0239508 A1 9/2013 Pervan et al.
2013/0263454 A1 10/2013 Boo et al.
2013/0263547 A1 10/2013 Boo
2013/0276398 A1* 10/2013 Hannig ..... E04F 15/02038 52/588.1
2013/0318906 A1 12/2013 Pervan et al.
2014/0007539 A1 1/2014 Pervan et al.
2014/0020324 A1 1/2014 Pervan
2014/0033634 A1 2/2014 Pervan
2014/0053497 A1 2/2014 Pervan et al.
2014/0059966 A1 3/2014 Boo
2014/0069043 A1 3/2014 Pervan
2014/0090335 A1 4/2014 Pervan et al.
2014/0109501 A1 4/2014 Pervan
2014/0109506 A1 4/2014 Pervan et al.
2014/0123586 A1 5/2014 Pervan et al.
2014/0150369 A1 6/2014 Hannig
2014/0190112 A1 7/2014 Pervan
2014/0208677 A1 7/2014 Pervan et al.
2014/0223852 A1 8/2014 Pervan
2014/0237931 A1 8/2014 Pervan
2014/0250813 A1 9/2014 Nygren et al.
2014/0260060 A1 9/2014 Pervan et al.
2014/0305065 A1 10/2014 Pervan
2014/0366476 A1 12/2014 Pervan
2014/0373478 A2 12/2014 Pervan et al.
2014/0373480 A1 12/2014 Pervan et al.
2015/0000221 A1 1/2015 Boo
2015/0013260 A1 1/2015 Pervan
2015/0059281 A1 3/2015 Pervan
2015/0089896 A2 4/2015 Pervan et al.
2015/0121796 A1 5/2015 Pervan
2015/0152644 A1 6/2015 Boo
2015/0167318 A1 6/2015 Pervan
2015/0211239 A1 7/2015 Pervan
2015/0233125 A1 8/2015 Pervan et al.
2015/0267419 A1 9/2015 Pervan
2015/0300029 A1 10/2015 Pervan
2015/0330088 A1 11/2015 Derelov
2015/0337537 A1 11/2015 Boo
2016/0032596 A1 2/2016 Nygren et al.
2016/0060879 A1 3/2016 Pervan
2016/0069088 A1 3/2016 Boo et al.
2016/0076260 A1 3/2016 Pervan et al.
2016/0090744 A1 3/2016 Pervan et al.
2016/0153200 A1 6/2016 Pervan
2016/0168866 A1 6/2016 Pervan et al.
2016/0186426 A1 6/2016 Boo
2016/0194884 A1 7/2016 Pervan et al.
2016/0201336 A1 7/2016 Pervan
2016/0251859 A1 9/2016 Pervan et al.
2016/0251860 A1 9/2016 Pervan
2016/0281368 A1 9/2016 Pervan et al.
2016/0281370 A1 9/2016 Pervan et al.
2016/0326751 A1 11/2016 Pervan
2016/0340913 A1 11/2016 Derelov
2017/0037641 A1 2/2017 Nygren et al.
2017/0081860 A1 3/2017 Boo
2017/0254096 A1 9/2017 Pervan
2017/0321433 A1 11/2017 Pervan et al.
2017/0362834 A1 12/2017 Pervan et al.
2018/0001509 A1 1/2018 Myllykangas et al.
2018/0001510 A1 1/2018 Fransson

(56) References Cited

U.S. PATENT DOCUMENTS

| | | | |
|---|---|---|---|
| 2018/0001573 | A1 | 1/2018 | Blomgren et al. |
| 2018/0002933 | A1 | 1/2018 | Pervan |
| 2018/0016783 | A1 | 1/2018 | Boo |
| 2018/0030737 | A1 | 2/2018 | Pervan |
| 2018/0030738 | A1 | 2/2018 | Pervan |
| 2018/0119431 | A1 | 5/2018 | Pervan et al. |
| 2018/0178406 | A1 | 6/2018 | Fransson et al. |
| 2019/0024387 | A1 | 1/2019 | Pervan |
| 2019/0048596 | A1 | 2/2019 | Pervan |
| 2019/0063076 | A1 | 2/2019 | Boo et al. |

FOREIGN PATENT DOCUMENTS

| | | | |
|---|---|---|---|
| DE | 10 2010 012 572 | B3 | 7/2011 |
| EP | 1 350 904 | A2 | 10/2003 |
| EP | 1 350 904 | A3 | 10/2003 |
| EP | 1 420 125 | A2 | 5/2004 |
| EP | 1 980 683 | A2 | 10/2008 |
| WO | WO 96/27721 | A1 | 9/1996 |
| WO | WO 00/20705 | A1 | 4/2000 |
| WO | WO 01/44669 | A2 | 6/2001 |
| WO | WO 01/44669 | A3 | 6/2001 |
| WO | WO 01/48332 | A1 | 7/2001 |
| WO | WO 2004/003314 | A1 | 1/2004 |
| WO | WO 2004/016877 | A1 | 2/2004 |
| WO | WO 2006/043893 | A1 | 4/2006 |
| WO | WO 2006/104436 | A1 | 10/2006 |
| WO | WO 2007/015669 | A2 | 2/2007 |
| WO | WO 2007/015669 | A3 | 2/2007 |
| WO | WO 2008/004960 | A2 | 1/2008 |
| WO | WO 2008/004960 | A3 | 1/2008 |
| WO | WO 2008/004960 | A8 | 1/2008 |
| WO | WO 2008/017281 | A1 | 2/2008 |
| WO | WO 2009/033623 | A1 | 3/2009 |
| WO | WO 2009/116926 | A1 | 9/2009 |
| WO | WO 2010/142671 | A1 | 12/2010 |
| WO | WO 2011/001326 | A2 | 1/2011 |
| WO | WO 2011/032540 | A2 | 3/2011 |
| WO | WO 2013/050367 | A1 | 6/2012 |

OTHER PUBLICATIONS

Extended European Search Report dated May 19, 2016 in EP 13772407.6, European Patent Office, Munich, DE, 5 pages.

Extended European Search Report dated Dec. 5, 2018 in EP 18205688.7, European Patent Office, Munich, DE, 8 pages.

* cited by examiner

BUILDING PANEL WITH A MECHANICAL LOCKING SYSTEM

CROSS REFERENCE TO RELATED APPLICATIONS

The present application is a continuation of U.S. application Ser. No. 15/583,002, filed on May 1, 2017, which is a continuation of U.S. application Ser. No. 15/066,722, filed on Mar. 10, 2016, now U.S. Pat. No. 9,663,940, which is a continuation of U.S. application Ser. No. 14/794,308, filed on Jul. 8, 2015, now U.S. Pat. No. 9,316,002, which is a continuation of U.S. application Ser. No. 14/612,881, filed on Feb. 3, 2015, now U.S. Pat. No. 9,091,077, which is a continuation of U.S. application Ser. No. 14/074,273, filed on Nov. 7, 2013, now U.S. Pat. No. 8,973,331, which is a continuation of U.S. application Ser. No. 13/855,966, filed on Apr. 3, 2013, now U.S. Pat. No. 8,596,013, which claims the benefit of U.S. Provisional Application No. 61/620,233, filed on Apr. 4, 2012. The entire contents of U.S. application Ser. No. 15/583,002, U.S. application Ser. No. 15/066,722, U.S. application Ser. No. 14/794,308, U.S. application Ser. No. 14/612,881, U.S. application Ser. No. 14/074,273, U.S. application Ser. No. 13/855,966, and U.S. Provisional Application No. 61/620,233 are hereby incorporated herein by reference in their entirety.

FIELD OF THE INVENTION

The present disclosure relates to a building panel such as a floor panel, a wall panel, a ceiling panel, a furniture component or the like, which is provided with a mechanical locking system, and a method for producing said building panel with said locking system.

TECHNICAL BACKGROUND

Building panels provided with a mechanical locking system comprising a displaceable and resilient tongue cooperating with a tongue groove for vertical locking is known and disclosed in, e.g., WO 2006/043893. The tongue is a separate part and is made of e.g. plastic and inserted in a displacement groove at an edge of a panel. The tongue is pushed into the displacement groove during a vertical assembling of the panels and springs back into the tongue groove of an adjacent panel when the panels have reached a locked position.

Also known is a locking system for panels comprising a tongue, which is displaceable along the edge of a panel, see, e.g., WO 2009/116926, and cooperates with a tongue groove for vertical locking. The tongue is a separate part and is provided with several protrusions, which initially match recesses of the tongue groove. The panels may be assembled by a vertical movement and the tongue is displaced to a position in which the protrusions no longer match the recesses in order to obtain the vertical locking.

Although the description relates to floor panel, the description of techniques and problems thereof is applicable also for other applications, such as panels for other purposes, for example wall panels, ceiling panels, furniture etc.

A drawback with the known system is that a separate tongue must be produced and special inserting machines are required to position the tongue in the displacement groove with high precision.

The above description of various known aspects is the applicant's characterization of such, and is not an admission that any of the above description is considered as prior art.

SUMMARY

It is an object of certain embodiments of the present disclosure to provide an improvement over the above described techniques and known art.

A further object is to provide a locking system with a flexible and displaceable tongue that may be formed out of the edge of the building panel. Such a system may simplify the production since no loose and additional part is necessary to produce and position at the correct position in the locking system.

Another object is to provide a more efficient production method and which requires less complicated production equipment.

At least some of these and other objects and advantages that will be apparent from the description have been achieved by building panels provided with a mechanical locking system comprising a tongue, at an edge of a first panel, cooperating with a tongue groove, at an edge of an adjacent second panel, for vertical locking of the building panels. The edge of the first panel may be provided with a displacement groove, which is downwardly open, and comprises an inner wall, an outer wall, and an upper wall. The tongue may be formed out of the edge of the first panel. A displaceable part of the tongue may be displaceable into the displacement groove and the upper wall may be vertically positioned at an upper surface of the displaceable part of the tongue.

The length of the displacement groove, along the edge of the first panel, is preferably smaller than the length of the edge of the first panel. The length of the displacement groove is preferably in the range of about 10% to about 90% of the length of the edge of the first panel The resilient and displaceable part of the tongue makes it possible to assemble the first and the second panel by displacing the edges vertically in relation to each other. A part of the edge of the second panel may push the displaceable part of the tongue into the displacement groove. The resilient and displaceable part of the tongue is preferably configured to be displaced into the displacement groove by a lower lip of the tongue groove during assembling of the first and the second panel. The displaceable part of the tongue may spring at least partly back, when the first and the second panel are positioned in a locked position, and into the tongue groove of the second panel. The part of the edge and the displaceable tongue part are preferably configured such that the displaceable part is pushed in an essentially horizontal direction. An essentially horizontal displacement may decrease the risk that the displaceable part of the tongue gets stuck in the displacement groove.

The upper wall may cooperate, for guiding the displaceable part of the tongue and/or for the vertical locking, with the upper surface.

The upper wall may be positioned somewhat above the upper surface of the displaceable part, but a position at an essential equal level, may make the locking system more stable and stronger.

The displacement groove may be arranged in relation to the edge of the first panel so that a thin wall or sidewardly open groove is created, at the outer wall of the displacement groove, above and/or below the displaceable part of the tongue.

The thickness of the outer wall of the displacement groove at a first and upper part of the displacement groove, at the upper surface of the tongue, is preferably configured such that the outer wall at the first and upper part breaks during said assembling of the building panels when the displaceable part of the tongue is pushed into the displacement groove.

The thickness of the outer wall of the displacement groove at a second part of the displacement groove, below the displaceable part of the tongue, is preferably configured such that such that the outer wall at second part breaks during said assembling of the building panels when the displaceable part of the tongue is pushed into the displacement groove.

The outer wall at the first and upper part of the displacement groove and/or the outer wall of the displacement groove at the second part of the displacement groove may also be broken by a tool, preferably a rotating wheel, before assembling. An alternative for breaking is to make a cut by a tool, e.g., a knife or preferably a rotating knife.

The displacement groove may also be sidewardly open at the first and/or second part of the displacement groove.

A wall that breaks may provide overlapping surfaces between the displacement groove and the displaceable part when the displaceable part is not pushed into the displacement groove. The overlapping surfaces make the locking system more stable and stronger.

A sidewardly open displacement groove makes it easier to push the displaceable part of the tongue into the displacement groove.

The broken outer wall of the displacement groove may cooperate, for guiding the displaceable part of the tongue and/or for the vertical locking, with the displaceable part of the tongue.

The tongue may comprise a fixed part at each side of the displaceable part of the tongue.

The tongue groove may comprise recesses, which match the fixed part of the tongue.

The recesses may be in a lower lip of the tongue groove. The length, along the edge of the second panel, of the lower lip between the recesses is preferably smaller than the length displacement groove.

A contact surface of the lower lip of the tongue groove may cooperate, for the vertical locking, with a lower surface of the displaceable part of the tongue.

The contact surface may be positioned such that when the displaceable part of the tongue springs back, during assembling of the building panels, the displaceable part is prevented to reach its original position. The lower surface of the displaceable part tongue may assert a force against the contact surface of lower lip in order to avoid a play between the panels.

The tongue may have several displaceable parts and the edge of the first panel may be provided with several displacement grooves.

The locking system may comprise a locking element, preferably arranged on a locking strip, at the edge of the first or the second panel, which cooperates with a locking groove at the edge of the other of the first or the second panel, for locking the panels horizontally.

The first and the second panel are preferably essential equal, thus an edge opposite said edge of the first panel is provided with the same parts of the locking system as said edge of the second panel.

The panels may be square-shaped and the edges between the said edge and said opposite edge are preferably provided with a locking system which enables assembling to an adjacent panel by an angling movement.

The displacement groove may be filled with a resilient material, such as plastic or rubber, to improve the resilient properties of the displaceable part and/or to make the locking system stronger.

The building panel may be a floor panel, a wall panel, a ceiling panel, a furniture component or the like.

The core of the building panels may be a wood-based core, preferably made of MDF, HDF, OSB, WPC, or particleboard or of plastic e.g. vinyl or PVC.

The edge of the panels, of which the locking system may be made, may comprise the core material.

A second aspect of the disclosure are building panels provided with a mechanical locking system comprising a tongue, at an edge of a first panel, cooperating with a tongue groove, at an edge of an adjacent second panel, for vertical locking of the building panels. The edge of the first panel may be provided with a displacement groove to obtain a resilient and displaceable tongue part. Said displacement groove may be downwardly open, and comprise an inner wall, an outer wall and an upper wall. The tongue may be formed out of the edge of the first panel. The resilient and displaceable part of the tongue may be configured to be displaced partly into the displacement groove by a lower lip of the tongue groove during assembling of the first and the second panel by a vertical displacement of the second panel toward the first panel.

The thickness of the outer wall of the displacement groove at a first and upper part of the displacement groove, above the upper surface of the tongue, is configured such that the resilient and displaceable tongue part is obtained. Also the thickness of the outer wall of the displacement groove at a second part of the displacement groove, below the resilient and displaceable part of the tongue, is configured such that the resilient and displaceable tongue part is obtained. The outer wall at the first and upper part and at the second part is not, according to certain embodiments of the second aspect, intended to break. The purpose of the displacement groove and the outer wall at the first and upper part and at the second part is to make the resilient and displaceable tongue part more resilient and to provide an improved locking strength.

The tongue may comprise fixed parts at the side of the resilient and displaceable part of the tongue.

The tongue groove may comprise recesses, which match the fixed part of the tongue.

A contact surface of a lower lip of the tongue groove may cooperate, for the vertical locking, with a lower surface of the resilient and displaceable part of the tongue.

The contact surface may be arranged such that when the displaceable part of the tongue springs back, during the assembling of the building panels, the displaceable part is prevented from reaching its original position.

The tongue may have several displaceable parts and the edge of the first panel may be provided with several displacement grooves.

Also parts of the lower lip of the tongue groove may be made flexible and resilient. This may be achieved by providing a displacement groove also at the edge of the second panel.

The building panel may be a floor panel, a wall panel, a ceiling panel, a furniture component or the like.

The core of the building panels may be a wood-based core, preferably made of MDF, HDF, OSB, WPC, or particleboard or of plastic e.g. vinyl or PVC.

The edge of the panels, of which the locking system may be made, may comprise the core material.

A third aspect of the disclosure is a method to produce a building panel according to embodiments of the first or second aspect. The method may comprise the steps of:

forming the tongue at the edge of the first panel.

forming the displacement groove at the underside of the first panel, preferably by milling, sawing and/or drilling.

milling the tongue groove at the opposite edge of said edge of the first panel.

forming the recesses in the lower lip of the tongue groove, preferably by milling, sawing and/or drilling.

BRIEF DESCRIPTION OF THE DRAWINGS

The present disclosure will by way of example be described in more detail with reference to the appended schematic drawings, which shows embodiments of the present disclosure.

DETAILED DESCRIPTION

Figure 1:
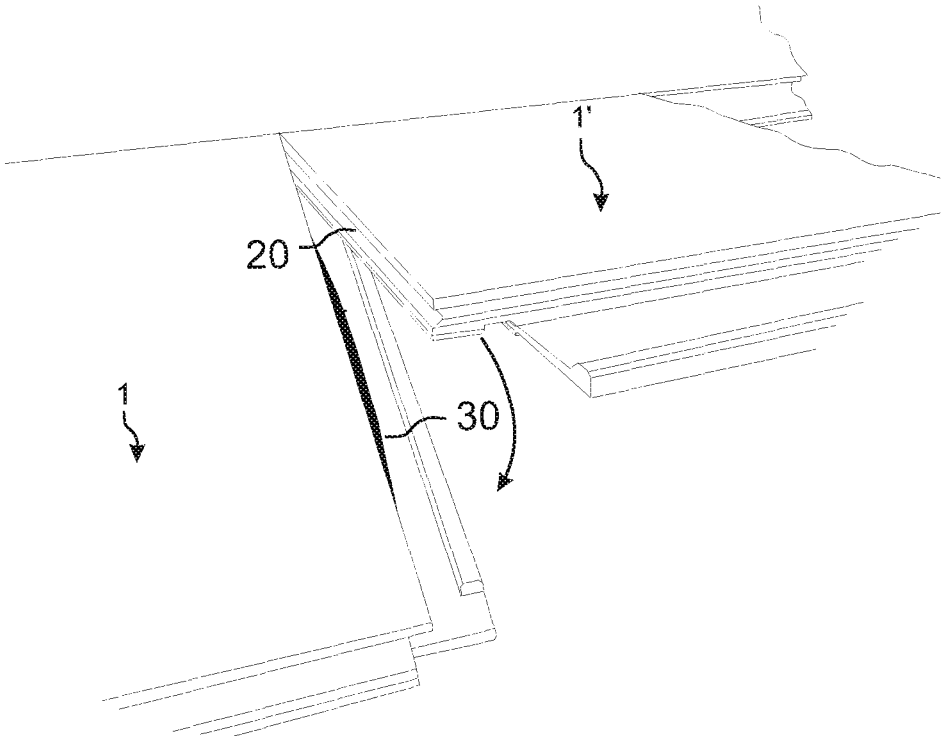
FIG. 1 shows a known locking system with a separate and resilient tongue.

A known locking system for building panels, which comprises a displaceable and resilient tongue 30 cooperating with a tongue groove 20 for vertical locking of the short edges is shown in FIG. 1. The tongue 30 is a separate part and is made of, e.g., plastic, and inserted in a displacement groove at a first short edge of a panel. The tongue is pushed into a displacement groove during a vertical assembling of the short edges of the panels and springs back into a tongue groove at a second short edge of an adjacent panel when the panels have reached a locked position. The long edges of the panels are provided with a locking system, which enables assembling to an adjacent panel by an angling movement, to obtain a simultaneous assembling of adjacent long and short edges.

Figure 2A:
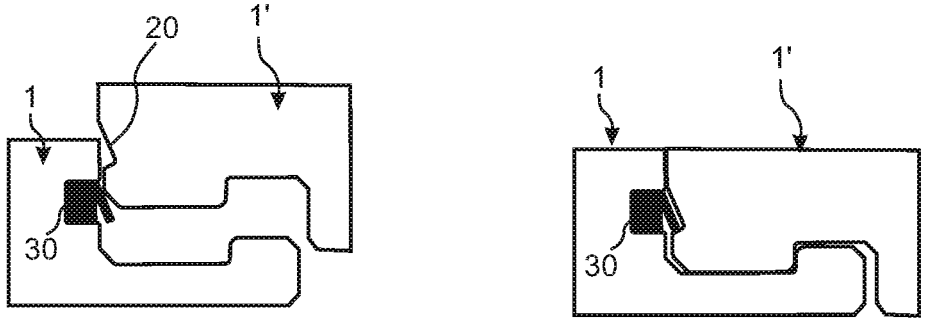
FIGS. 2A-C shows a cross section of a known locking system with a separate and displaceable tongue.
Figure 2B:
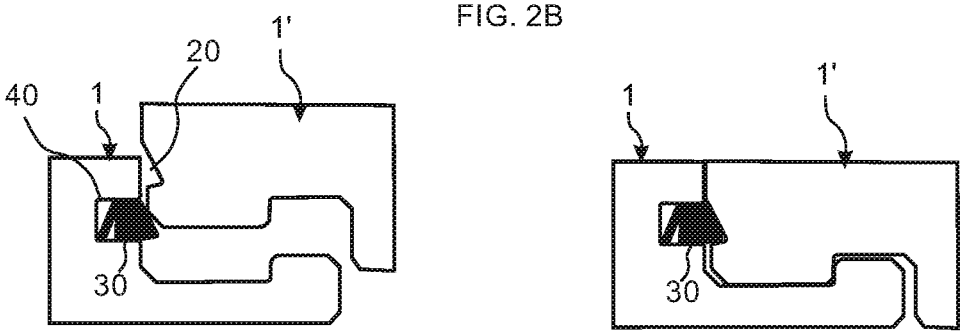
Figure 2C:
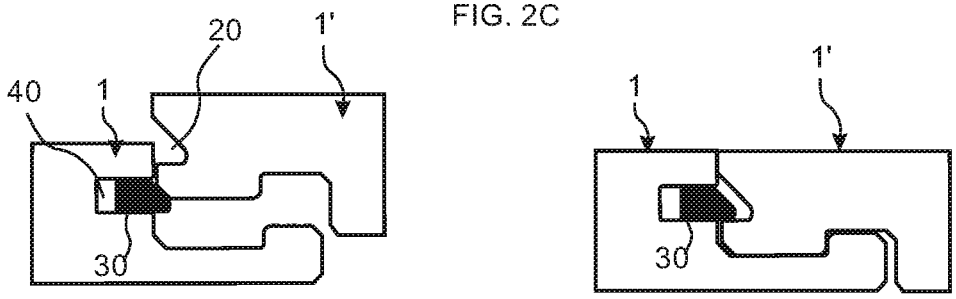

FIGS. 2*a-b* show cross sections of different embodiments of the known displaceable and resilient tongue 30 during assembling of two adjacent short edges. The panel with the tongue groove is lowered in relation to the panel with tongue 30, which is pushed into the displacement groove by the lowered panel. The tongue springs back, and into the tongue groove, when the panels have reached an assembled position, and locks the panels vertically.

Figure 3:
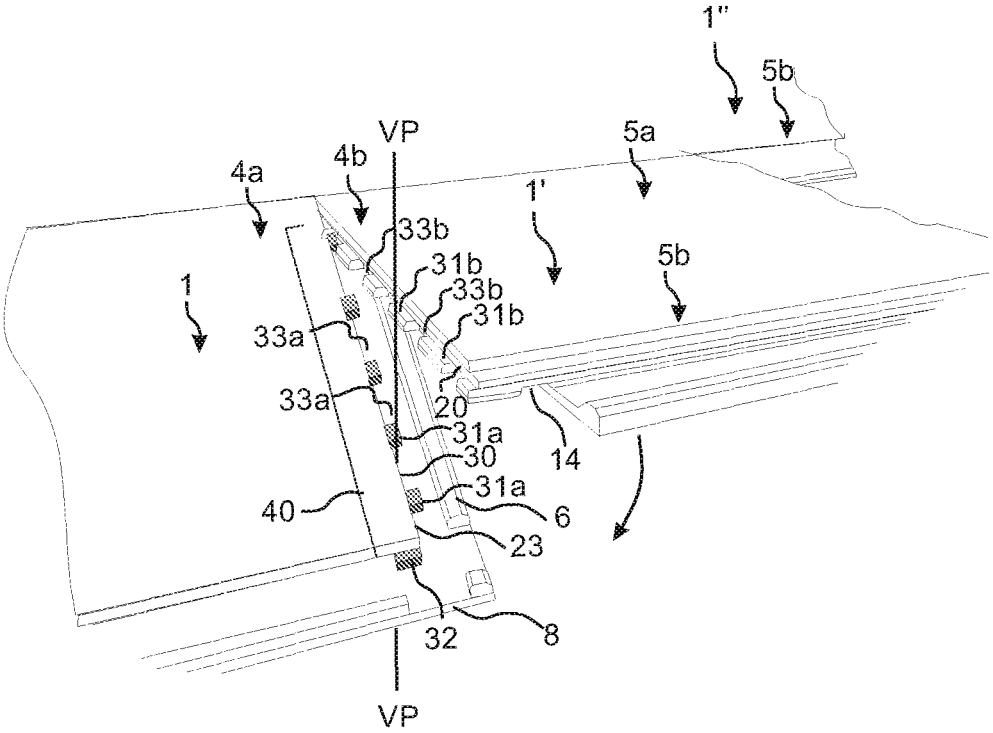
FIG. 3 shows a known locking system with a separate and displaceable tongue.

A known locking system for panels comprising a tongue 30, which is displaceable along the short edge 4*a* of a panel 1 in a displacement groove 40 and cooperates with a tongue groove 20 for vertical locking of adjacent short edges 4*a*, 4*b* is disclosed in FIG. 3. The tongue is a separate part and is provided with several protrusions 31*a*, which initially match recesses 33*b* of the tongue groove 20. The panels 1, 1' may be assembled by a vertical movement and the tongue is displaced, by applying a force at a part 32 of the tongue 30, to a position in which the protrusions no longer match the recesses in order to obtain the vertical locking. The long edges 5*a*, 5*b* of the panels are provided with a locking system, which enables assembling to an adjacent panel 1" by an angling movement, to obtain a simultaneous assembling of adjacent long 5*a*, 5*b* and short edges 4*a*, 4*b*.

Embodiments of the disclosure are shown in FIGS. 4, 5, 6*a-c*, 7*a-d*, 8*a-b* and 9*a-b*. A locking system is formed at adjacent edges of an adjacent first and second panel 1, 1' for locking the adjacent edges in a vertical and/or horizontal direction. An embodiment of the locking system enables assembling of panels at the adjacent edges by a vertical movement, see FIGS. 7*a-d*. The locking system is preferably formed by mechanical cutting, such as milling, drilling and/or sawing, of the edges of the panels.

A tongue 30 is formed at an edge of the first panel 1. The tongue 30 cooperates with a tongue groove 20, which is formed at an edge of an adjacent panel 1', for vertical locking of the panel 1, 1'. A locking strip 8 with a vertically protruding locking element is formed in the edge of the first panel. The locking element 6 cooperates with a locking groove 14, formed at the edge of the second panel 1', for horizontal locking of the panels 1, 1'.

A displacement groove 60 is formed in the edge of the first panel behind the tongue 30. The displacement groove 60 makes a part 66 of the tongue 30 displaceable. During assembling of the first and the second panel 1, 1' the displaceable part 66 is pushed into the displacement groove 60 by a lower lip 31 of the tongue groove 20. When the panels are in a locked position the displaceable part 66 springs back and into the tongue groove 20.

Other parts 68 of the tongue 30, beside the displacement groove 60 and the displaceable part 66 of the tongue 30, is fixed. To enable the panels 1, 1' to be assembled by a vertical movement, recesses 69 are formed in a lower lip 31 of the tongue groove 20. The recesses 69 match the fixed parts 68 of the tongue.

Figure 4:
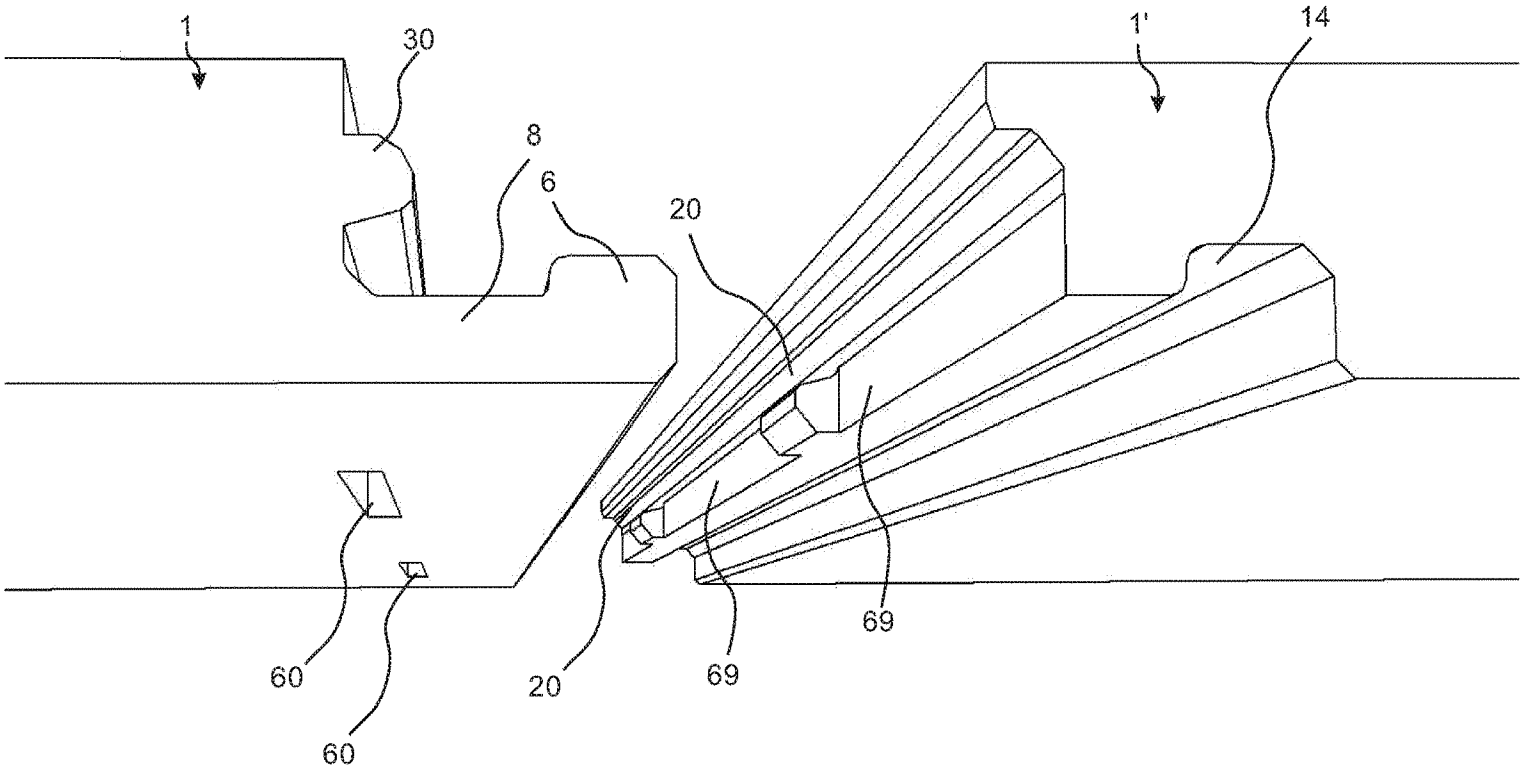
FIG. 4 shows a 3D view of building panels according to an embodiment of the disclosure.
Figure 5:
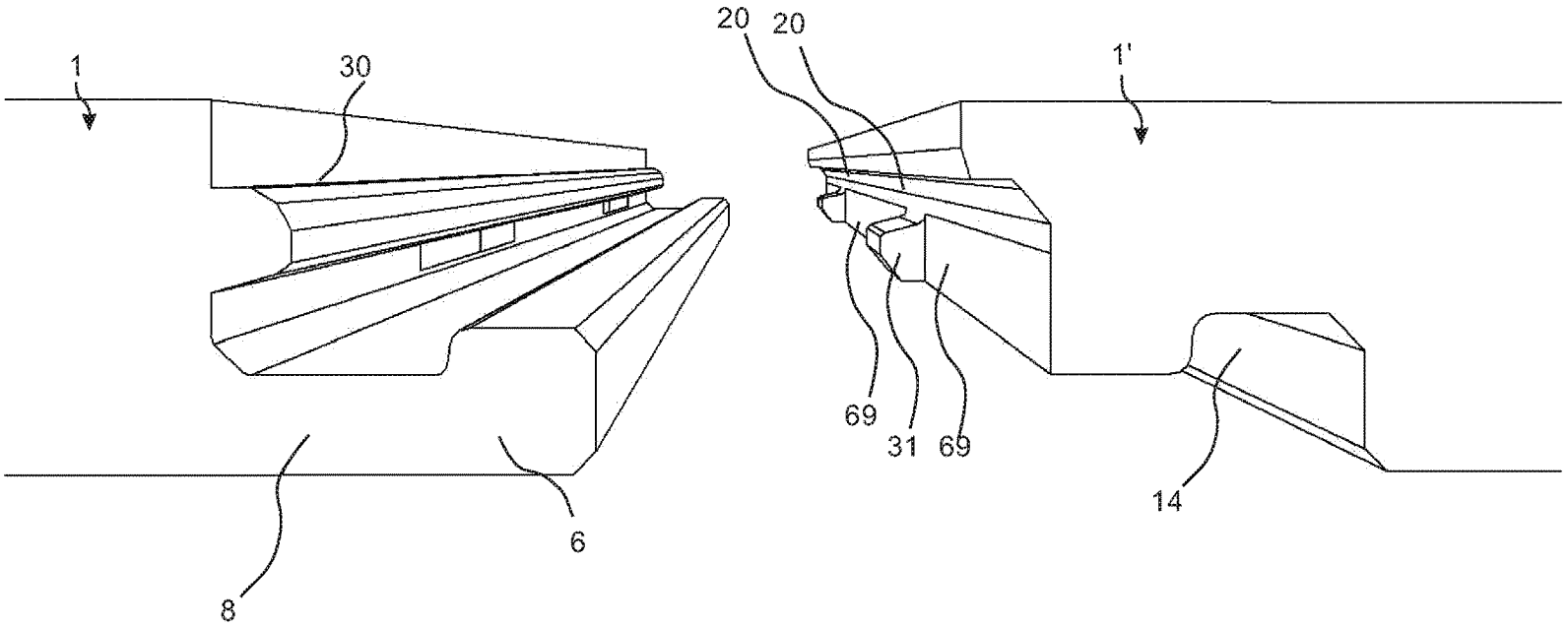
FIG. 5 shows a 3D view of building panels according to an embodiment of the disclosure.
Figure 6A:
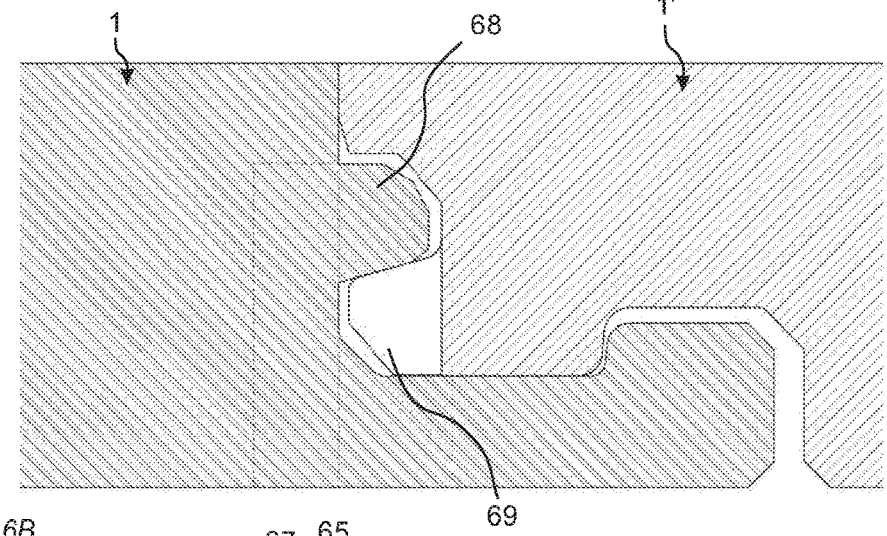
FIGS. 6A-B show cross sections of building panels according to an embodiment of the disclosure.
Figure 6B:
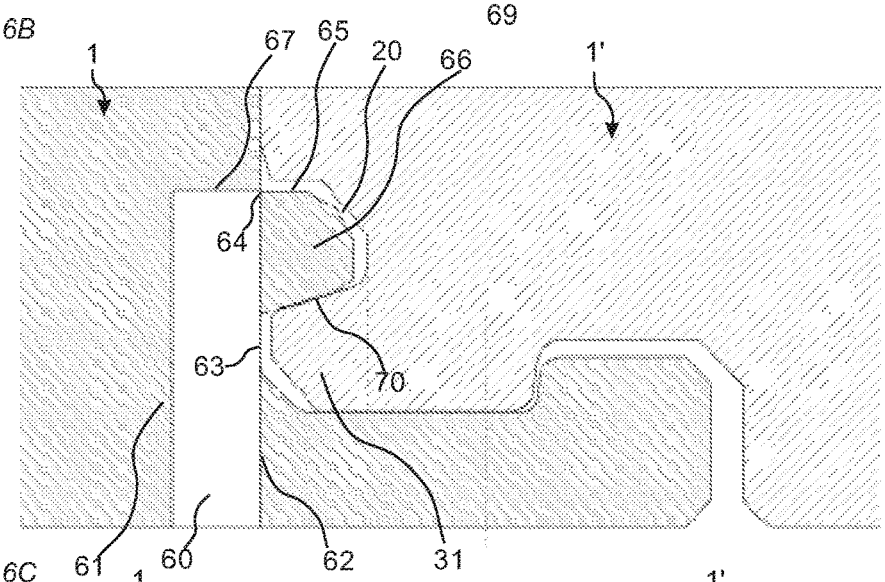

FIGS. 4, 5, 6*a-c*, 7*a-d* and 8*b* show a first embodiment comprising a tongue 30 with two displaceable parts 66 and three fixed parts 68, two displacement grooves 60, and a lower lip 31 of a tongue groove 20 with three recesses 69. The cross section in FIG. 6*a* is at the D-D line indicated in FIG. 8*a* and the cross section in FIG. 6*b* is at the C-C line indicated in FIG. 8*a*.

Figure 8A:
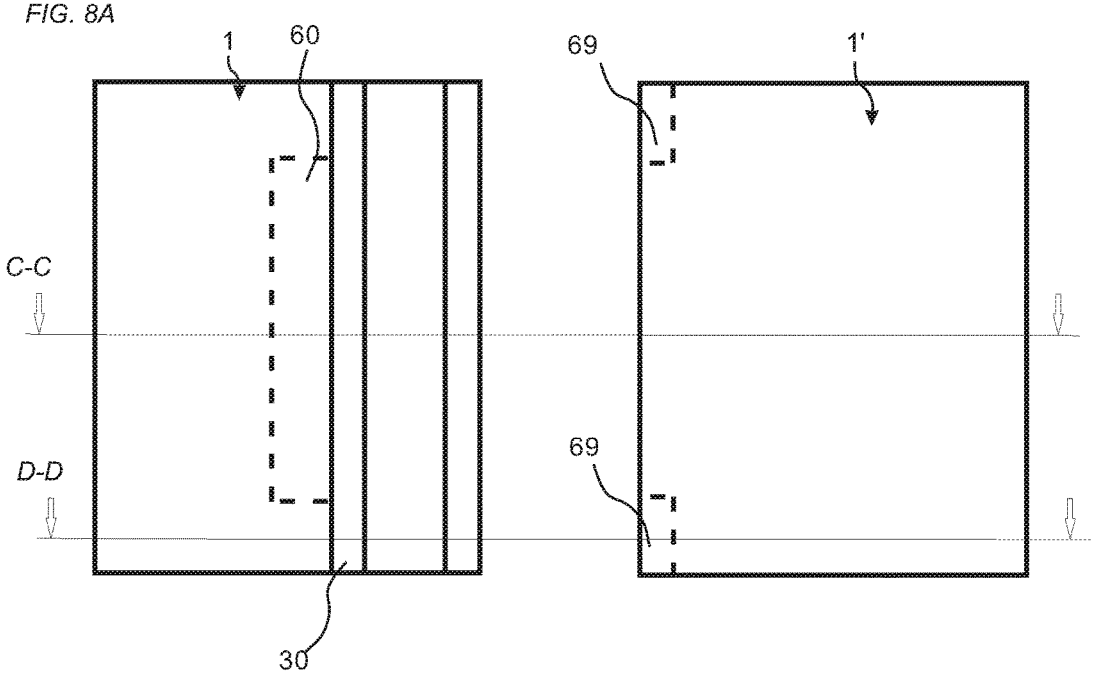
FIGS. 8A-B show top views of the building panels according to embodiments of the disclosure.
Figure 8B:
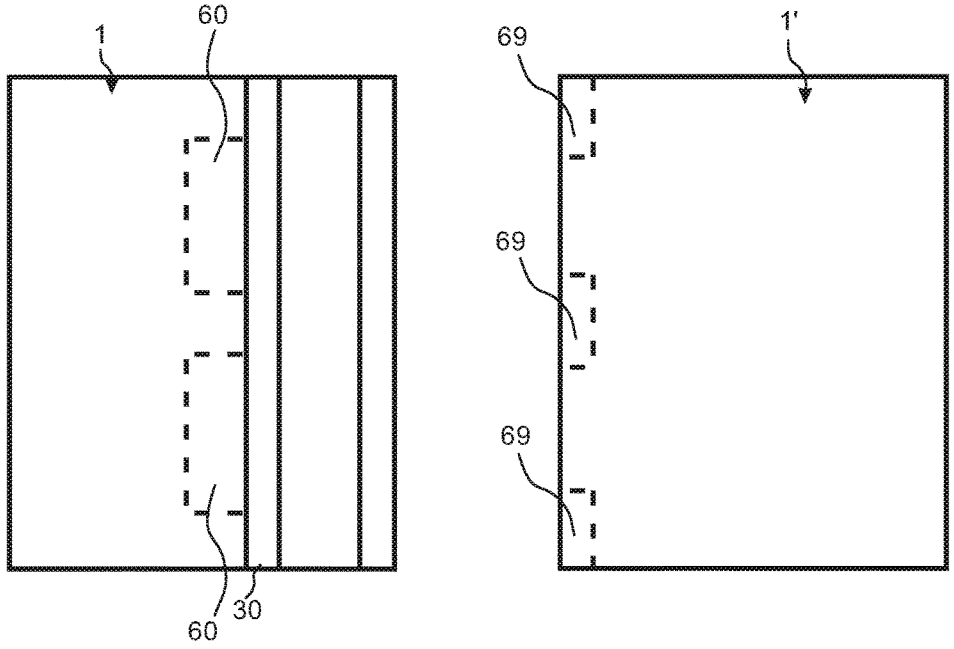

FIG. 8*a* shows a second embodiment comprising a tongue 30 with one displaceable part 66 and two fixed parts 68, one displacement groove 60, and a lower lip of the tongue groove 20 with two recesses 69.

The first embodiment is shown in a 3D view in FIGS. 4 and 5.

Figure 6C:
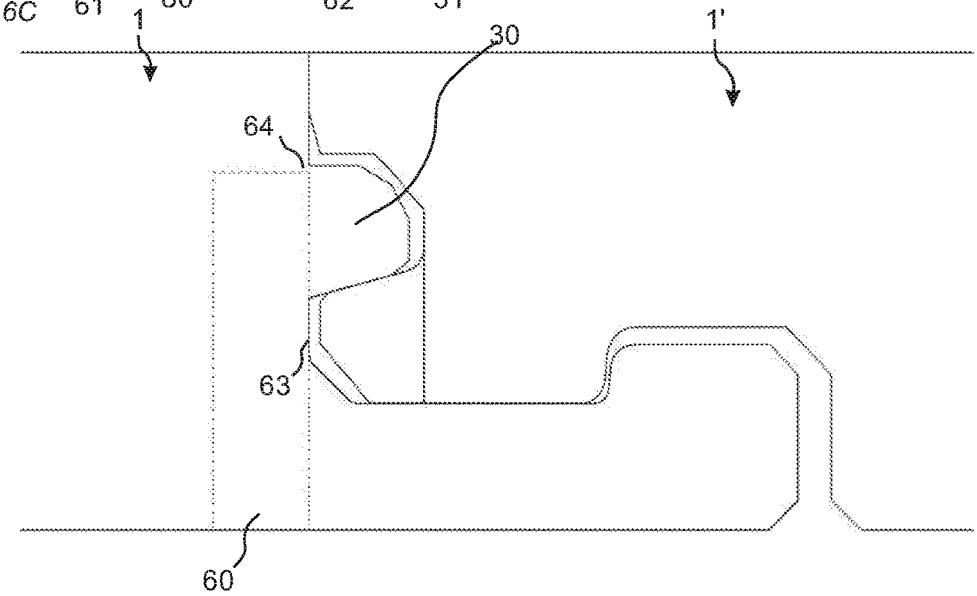
FIG. 6C shows a side view of building panels according to an embodiment of the disclosure.
Figure 7A:
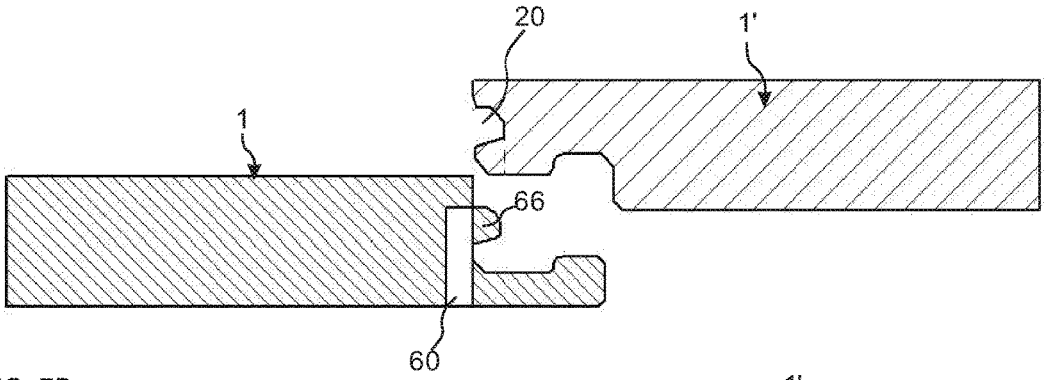
FIGS. 7A-D shows an embodiment of assembling according to an embodiment of the disclosure.
Figure 7B:
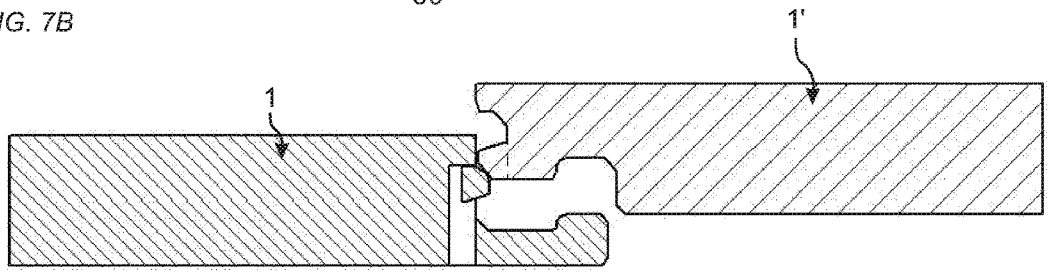
Figure 7C:
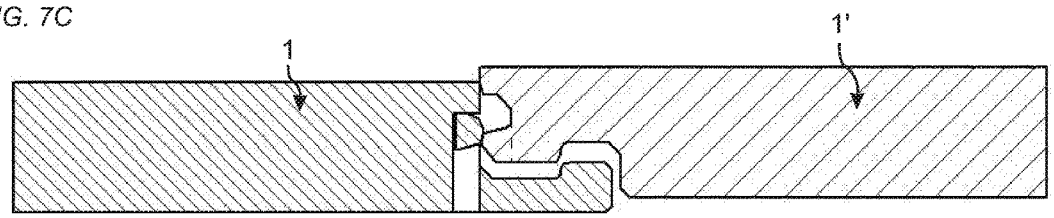
Figure 7D:
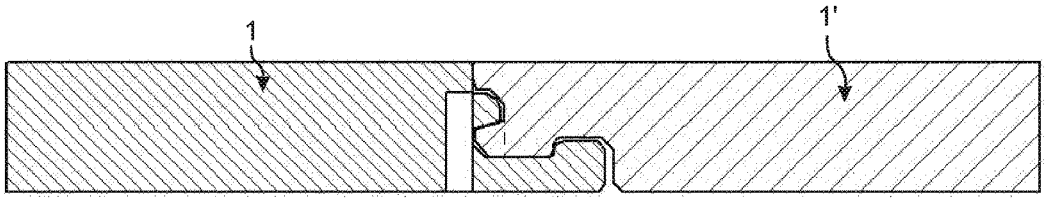

The cross sections in FIGS. 6*a* and *b* and the side view in FIG. 6*c*, show that a lower surface of the displaceable part 66 cooperates, for vertical locking of adjacent edges of the panels 1,1', with a contact surface 70 of the lower lip 31 of the tongue groove 20. A vertical movement of the displaceable part is restrained, since the displaceable part of the tongue is continuous with the fixed part 68 of the tongue 30*a*.

The displacement groove 60 is formed from the underside of the first panel 1' and comprises an inner wall 61, an outer wall 62, and an upper wall 67. The displacement groove 60 may be positioned, in relation to the edge of the first panel, such that the thickness of the outer wall at a first 64 and upper part of the displacement groove 60, at the upper surface 65 of the tongue 30, is configured such that the outer wall breaks during assembling of the building panels when the displaceable part 66 of the tongue is pushed into the displacement groove 60.

The displacement groove 60 may also be positioned, in relation to the edge of the first panel, such that the thickness of the outer wall of the displacement groove 60 at a second part 63 of the displacement groove 60, below the displaceable part 66 of the tongue 30, is configured such that outer wall breaks during assembling of the building panels when the displaceable part 66 of the tongue is pushed into the displacement groove 60.

The walls at the at the first 64 and upper part of the displacement groove 60 and/or the second part 63 of the displacement groove 60 may also be broken before assembling of the building panels by pushing the displaceable part 66 of the tongue 30 into the displacement groove by a tool, such as a rotating wheel. An alternative is to use a cutting tool, such as a rotating wheel to separate the displaceable part 66 from the walls.

The broken outer wall of the displacement groove may cooperate with the displaceable part of the tongue and thereby improve the guiding of the displaceable part 66 of the tongue 30 and/or improve the vertical locking.

If the displacement groove 60 is positioned, relation to the edge of the first panel, such that a sidewardly open groove is formed at the first and/or second part 64, 63 of the displacement groove, the force required to push the displaceable part 66 of the tongue 30 into the displacement groove 60 is lowered.

Figure 9A:
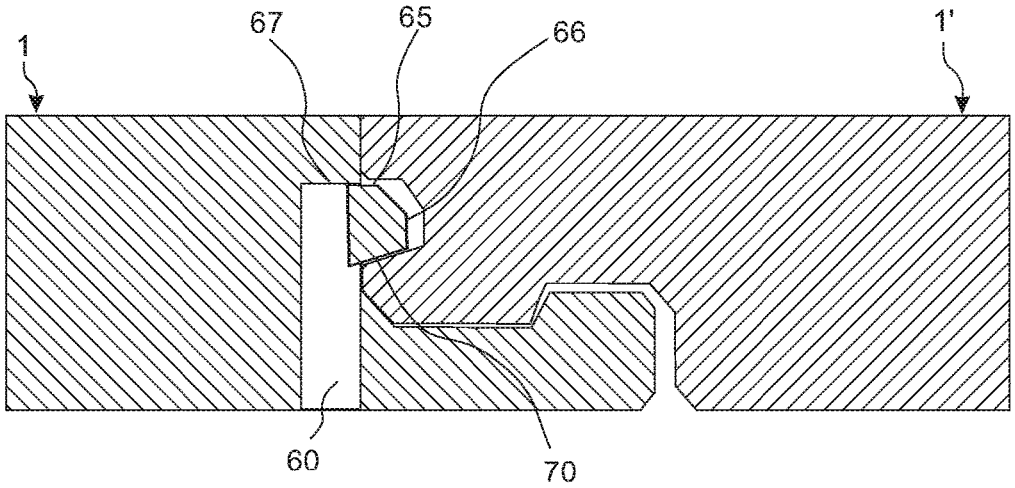
FIGS. 9A-B show a cross of the building panels according to embodiments of the disclosure.
Figure 9B:
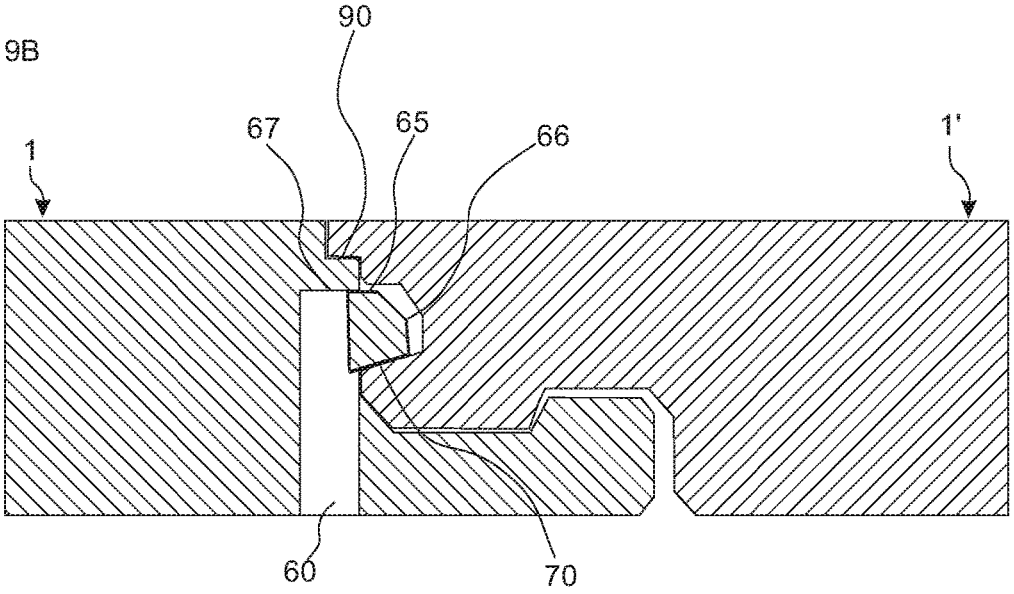

The contact surface 70 of the lower lip 31 may be positioned such that the displaceable part 66 of the tongue 30 is prevented to spring back to its initial position before assembling and thereby remains, in an assembled and locked position of the panels 1, 1', partly in the displacement groove 66. This position of the contact surface 70 result in that the lower surface of the displaceable part of the tongue asserts a force against the contact surface of lower lip in the locked position of the panels 1,1', which is shown in FIGS. 9*a* and 9*b*. The asserted force improves the locking and a play between the panels may be possibly avoided or reduced.

To decrease the force applied on the tongue when a load is applied on the building panels and to further improve the strength and tolerances of the locking system, the edges of the adjacent panels may be provided with upper overlapping surfaces 90, which are shown in FIG. 9*b*. The upper overlapping surfaces are preferably essentially horizontal.

If the tongue remains in the displacement groove 60 the upper wall 67 of the displacement groove 60 may cooperate, for an improved vertical locking of the adjacent edges of the first and second panels 1,1', with an upper surface 65 of the displaceable part 66 of the tongue 30.

In order to improve the spring properties of the displaceable part 66 of the tongue 30, the displacement groove 60 may be filled or provided with an elastic material such as plastic or rubber. The improved spring properties may result in an improved locking.

Figure 10A:
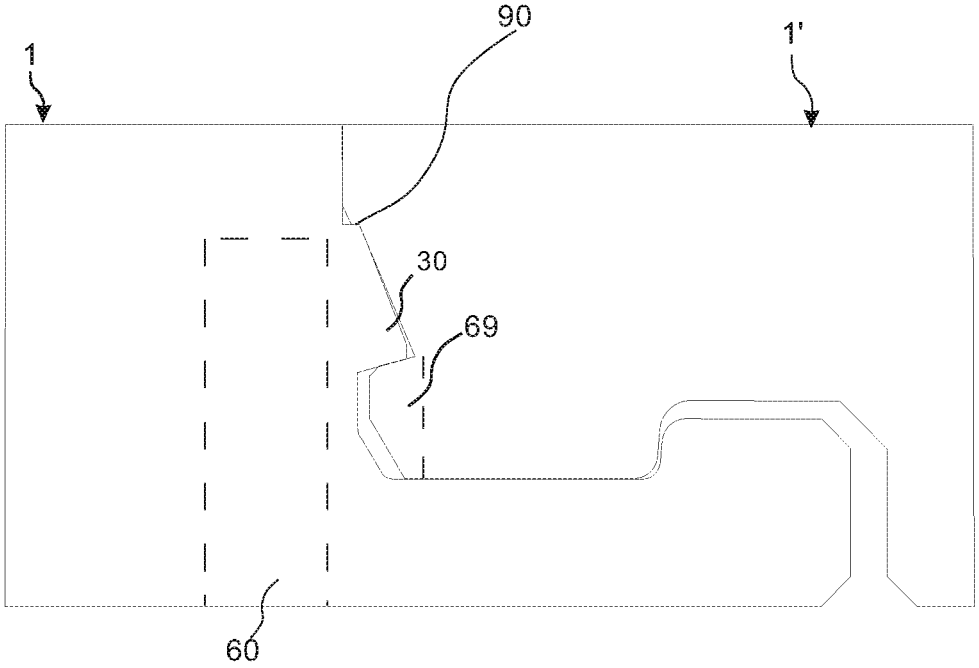
FIGS. 10A-B show a top view and a side view of the building panels according to an embodiment of the disclosure.
Figure 10B:
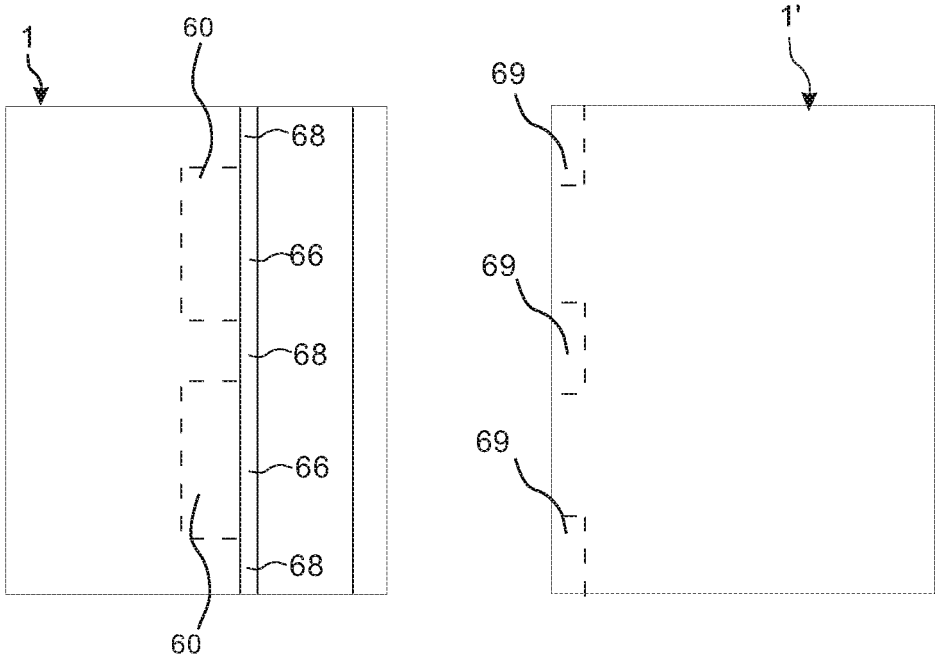
Figure 12A:
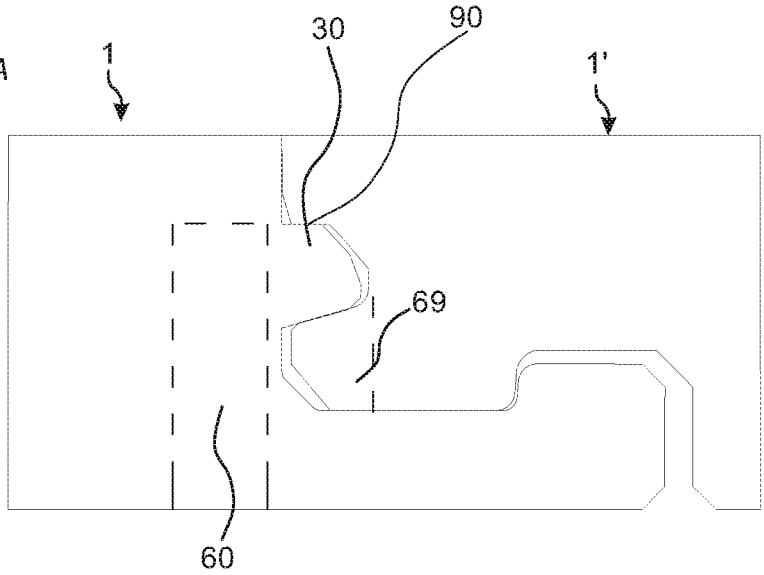
FIGS. 12A-C show a side view and two cross-sections of building panels according to embodiments of the disclosure.

An embodiment comprising a displacement groove 60 with an outer wall, which is not intended to break during assembling, is shown in FIG. 10*a*. The side view in FIG. 10*a* shows that the distance from the edge of the first panel 1 is increased. The displacement groove has the result that a resilient and displaceable tongue part 66 is obtained. The top view in FIG. 10*b* shows an embodiment with an edge of a first panel 1 comprising two displacement grooves 60 and a tongue 30 with two resilient and displaceable parts 66 and three fixed parts 68 and an adjacent edge of a second panel 1' comprising a tongue groove with a lower lip provided with three recesses 69 that matches the fixed parts 68 of the tongue. The tongue comprises an upper essentially horizontal surface 90, which preferably extends along the whole edge. The upper essentially horizontal surface increases the strength of the locking system. FIG. 12*a* shows in a side view that the size of the tongue may be increased for building panels comprising favorably resilient material.

Figure 11A:
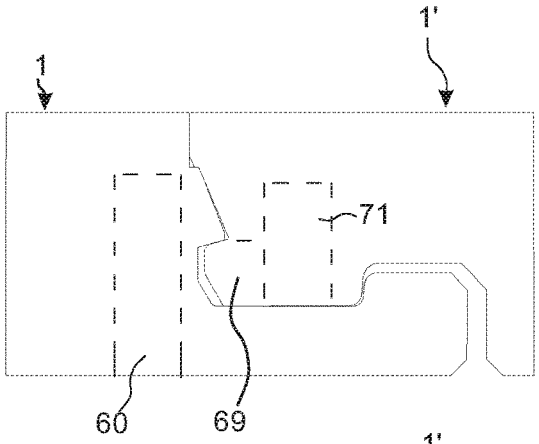
FIGS. 11A-D show a top view, a side view and two cross sections of building panels according to an embodiment of the disclosure.
Figure 11B:
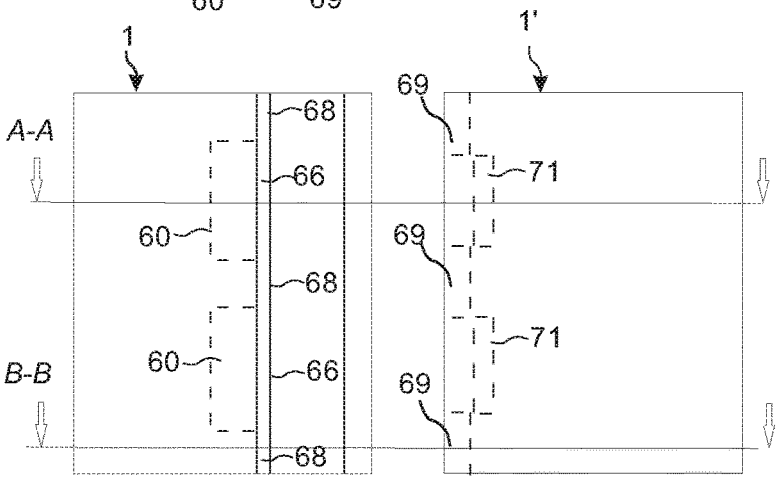
Figure 11C:
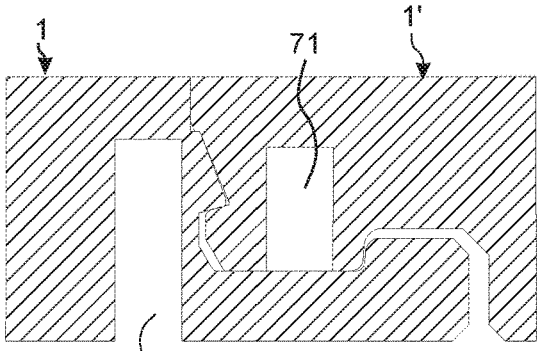
Figure 11D:
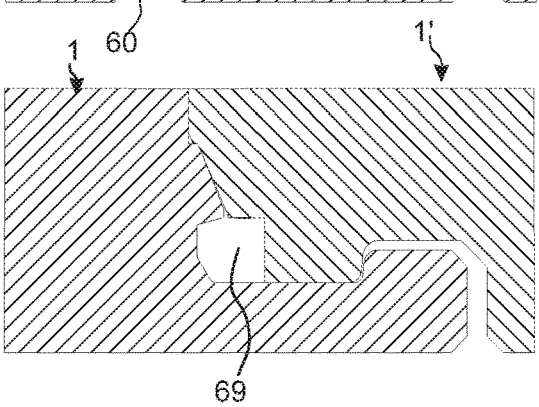

FIGS. 11*a-c* show an embodiment in which also parts of the lower lip of the tongue groove is made flexible and resilient. This is achieved by providing a displacement groove also at the edge of the second panel. The side view in FIG. 11*a* and the cross section 11*c* show an embodiment comprising a displacement groove 71 which downwardly open at a distance from the tongue groove. The cross section in FIG. 11*c* is indicated in the top view in FIG. 11*b* by the A-A line. The cross section in FIG. 11*d* is indicated in the top view in FIG. 11*b* by the B-B line. The top view in FIG. 11*b* shows an embodiment with an edge of a first panel 1 comprising two displacement grooves 60 and a tongue with two resilient and displaceable parts 66 and three fixed parts 68 at an edge of a first panel 1, and an adjacent edge of a second panel 1' comprising a tongue groove with a lower lip provided with three recesses 69 that correspond to fixed parts 68 of the tongue, and two displacement grooves 71, to obtain two flexible parts at the lower lip of the tongue groove.

Figure 12B:
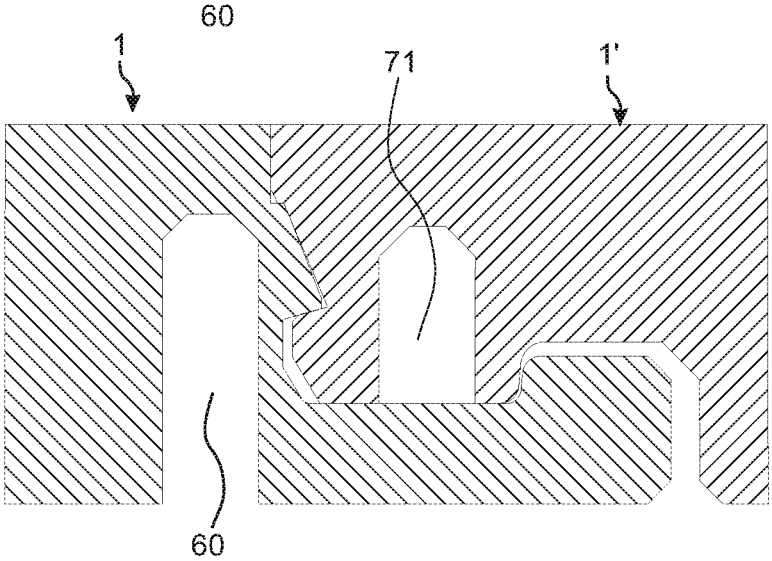
Figure 12C:
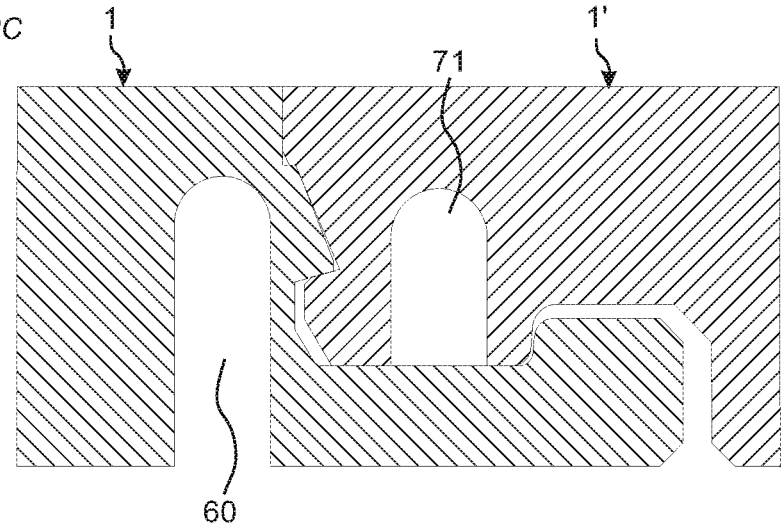

Alternative shapes of displacement grooves 60, 71 at the edge of the first and second panel 1, 1' are shown in FIGS. 12*b-c*. The upper wall of the displacement groove is of a rounded shape in order to increase the strength of the displacement groove.

The invention claimed is:

1. Building panels provided with a mechanical locking system comprising a tongue, at an edge of a first panel, cooperating with a tongue groove, at an edge of an adjacent second panel, for vertical locking of the building panels wherein the tongue comprises a resilient and displaceable tongue part, the edge of the first panel is provided with a displacement groove to obtain the resilient and displaceable tongue part, said displacement groove is downwardly open, and comprises an inner wall, an outer wall and a planar upper wall, the tongue is formed out of the edge of the first panel, the resilient and displaceable tongue part is configured to be displaced into the displacement groove by a lower lip of the tongue groove during assembling of the first and the second panel by a vertical displacement of the second panel toward the first panel, the outer wall of the displacement groove at a first and upper part of the displacement groove, at the upper surface of the tongue, is sidewardly open, such that, in a stress-free state before the resilient and displaceable tongue part is displaced into the displacement groove, the resilient and displaceable tongue part is entirely located vertically lower than the planar upper wall of the displacement groove, and the outer wall of the displacement groove at a second part of the displacement groove, below the resilient and displaceable part of the tongue, is sidewardly open.

2. Building panels as claimed in claim 1, wherein the upper wall is vertically positioned at an upper surface of the resilient and displaceable tongue part.

3. Building panels as claimed in claim 2, wherein the upper wall is configured to guide the resilient and displaceable tongue part.

4. Building panels as claimed in claim 2, wherein the upper wall is configured to cooperate with the upper surface of the resilient and displaceable tongue part for the vertical locking.

5. Building panels as claimed in claim 1, wherein the second part is configured to guide the resilient and displaceable tongue part during the assembling.

6. Building panels as claimed in claim 1, wherein the second part cooperates with the resilient and displaceable tongue part for the vertical locking.

7. Building panels as claimed in claim 1, wherein the tongue comprises fixed parts at the side of the resilient and displaceable tongue part.

8. Building panels as claimed in claim 7, wherein the tongue groove comprises recesses, which correspond to the fixed parts of the tongue.

9. Building panels as claimed in claim 1, wherein a contact surface of a lower lip of the tongue groove cooperates, for the vertical locking, with a lower surface of the resilient and displaceable tongue part.

10. Building panels as claimed in claim 9, wherein the contact surface is arranged such that when the resilient and displaceable tongue part springs back, during the assembling of the building panels, the resilient and displaceable tongue part is prevented from reaching its original position.

11. Building panels as claimed in claim 1, wherein the tongue has several resilient and displaceable tongue parts and that the edge of the first panel is provided with several displacement grooves.

12. Building panels as claimed in claim 1, wherein the edge of the first panel and the edge of the second panel are provided with upper overlapping surfaces.

13. Building panels as claimed in claim 1, wherein the displacement groove is provided with an elastic material therein.

14. Building panels provided with a mechanical locking system comprising a tongue, at an edge of a first panel, cooperating with a tongue groove, at an edge of an adjacent second panel, for vertical locking of the building panels wherein the tongue comprises a resilient and displaceable tongue part, the edge of the first panel is provided with a displacement groove to obtain the resilient and displaceable tongue part, said displacement groove is downwardly open, and comprises an inner wall, an outer wall and a planar upper wall, the tongue is formed out of the edge of the first panel, the resilient and displaceable tongue part is configured to be displaced into the displacement groove by a lower lip of the tongue groove during assembling of the first and the second panel by a vertical displacement of the second panel toward the first panel, the outer wall of the displacement groove at a first and upper part of the displacement groove, at the upper surface of the tongue, comprises a sidewardly-facing cut, such that, in a stress-free state before the resilient and displaceable tongue part is displaced into the displacement groove, the resilient and displaceable tongue part is entirely located vertically lower than the planar upper wall of the displacement groove, and the outer wall of the displacement groove at a second part of the displacement groove, below the resilient and displaceable part of the tongue, is sidewardly open.

15. Building panels as claimed in claim 14, wherein the upper wall is vertically positioned at an upper surface of the resilient and displaceable tongue part.

16. Building panels as claimed in claim 14, wherein the upper wall is configured to guide the resilient and displaceable tongue part.

17. Building panels as claimed in claim 14, wherein the upper wall is configured to cooperate with the upper surface of the resilient and displaceable tongue part for the vertical locking.

18. Building panels as claimed in claim 14, wherein the second part is configured to guide the resilient and displaceable tongue part during the assembling.

19. Building panels as claimed in claim 14, wherein the second part cooperates with the resilient and displaceable tongue part for the vertical locking.

20. Building panels as claimed in claim 14, wherein the tongue comprises fixed parts at the side of the resilient and displaceable tongue part.

21. Building panels as claimed in claim 20, wherein the tongue groove comprises recesses, which correspond to the fixed parts of the tongue.

22. Building panels as claimed in claim 14, wherein a contact surface of a lower lip of the tongue groove cooperates, for the vertical locking, with a lower surface of the resilient and displaceable tongue part.

23. Building panels as claimed in claim 22, wherein the contact surface is arranged such that when the resilient and displaceable tongue part springs back, during the assembling of the building panels, the resilient and displaceable tongue part is prevented from reaching its original position.

24. Building panels as claimed in claim 14, wherein the edge of the first panel and the edge of the second panel are provided with upper overlapping surfaces.

25. Building panels as claimed in claim 14, wherein the displacement groove is provided with an elastic material therein.

* * * * *